US005133692A

United States Patent [19]

Koop

[11] Patent Number: 5,133,692

[45] Date of Patent: Jul. 28, 1992

[54] LIGHT RESTRICTING HOUSING FOR A VENTILATION SYSTEM

[75] Inventor: Edward N. Koop, Olathe, Kans.

[73] Assignee: Emerson Electric Co., St. Louis, Mo.

[21] Appl. No.: 669,599

[22] Filed: Mar. 14, 1991

[51] Int. Cl.[5] ..... F24F 13/18

[52] U.S. Cl. ..... 454/282; 454/905

[58] Field of Search ..... 98/121.1, DIG. 9

[56] References Cited

U.S. PATENT DOCUMENTS 3,285,156 11/1966 Bohanon ..... 98/121.1
3,628,442 12/1971 Hijhuis ..... 98/121.1
3,771,430 11/1973 Lane ..... 98/121.1
3,968,738 7/1976 Matzke ..... 98/121.1 X

*Primary Examiner*—Harold Joyce
*Attorney, Agent, or Firm*—Polster, Lieder, Woodruff & Lucchesi

[57] ABSTRACT

A light restricting housing for a ventilating system including a flow-through frame member having a plurality of spaced parallel blade members disposed there, the blade members being contoured to obscure direct passage of light therethrough and including displacement means on the planar surfaces thereof to hold the blade members in spaced relation to each other.

11 Claims, 4 Drawing Sheets

LIGHT RESTRICTING HOUSING FOR A VENTILATION SYSTEM

BACKGROUND OF THE INVENTION

The present invention relates to light restricting structure and more particularly to an improved light restricting housing for a ventilation system which can be used in conjunction with those activities requiring both ventilation and accompanying light restriction, such as in auditoriums, photographic equipment and dark rooms and particularly, as in livestock housings, including housings for poultry where air ventilated and artificially lighted environments have been found to be most desirable.

It is generally known in those situations where it has been found desirable to provide ventilation and concomitant direct light reduction or obscurence to use spaced blade members with surfaces geometrically configured to prevent passage of direct light therethrough. Such past blade member assemblies have included air stream flow-through housings provided with rods and spacers or tabs and slots to position the blade members in appropriately spaced position. It is recognized by the present invention that such past assemblies have been comparatively complex to manufacture and assemble, requiring several parts that necessarily must be fixtured and assembled in proper alignment with the resulting assemblies presenting problems in operation, fixturing, wear and maintenance.

The present invention, recognizing these past problems provides an improved and light restricting housing for a ventilation system which is straightforward and economical in manufacture and assembly without time consuming fixturing. The structure of the present invention is efficient in operation and maintenance, allowing for ready drainage and cleaning and at the same time utilizing a minimum of parts in efficiently accomplishing both ventilation and light control in a unique arrangement for manufacturing, assembling and spacing blade members for utilization in a novel ventilating and light control system.

Various other features of the present invention will become obvious to one skilled in the art upon reading the disclosure set forth herein.

BRIEF SUMMARY OF THE INVENTION

More particularly the present invention provides a light restricting housing for a ventilating air system comprising: a flow-through frame member including an upstream ventilating air inlet and a downstream ventilating air outlet; a plurality of longitudinally extending blade members disposed in the flow-through frame member to extend thereacross in spaced parallel relation between the upstream ventilating air inlet and the downstream ventilating air outlet, the blade members each having a cross-section contoured to obscure direct passage of light therethrough between upstream air inlet and downstream air outlet; means to retain the blade members in disposed position within the flow-through frame member; and, displacement means on the planar faces of the blade members to hold the blade members in spaced relation to each other. In addition, the present provides a unique blade configuration which enhances the overall stability of the assembly. Further, the present invention provides an assembly structure which allows for ready gravity drainage through the frame and for efficient maintenance and cleaning.

It is to be understood that various changes can be made by one skilled in the art in one or more of the several parts of the inventive structure disclosed without departing from the scope or spirit of the invention. For example, the blade members can be formed in different cross-sectional configurations and the frame member itself can be of a different geometrical configuration from that disclosed.

BRIEF DESCRIPTION OF THE DRAWINGS

Referring to the drawings which disclose one advantageous embodiment of the inventive structure and a modification thereof:

FIG. 3 is an enlarged bottom view of the housing of FIG. 1, this view serving to disclose the unique, straightforward drainage structure for the assembly of FIGS. 1 and 2;

DETAILED DESCRIPTION OF THE DRAWINGS

Figure 1:
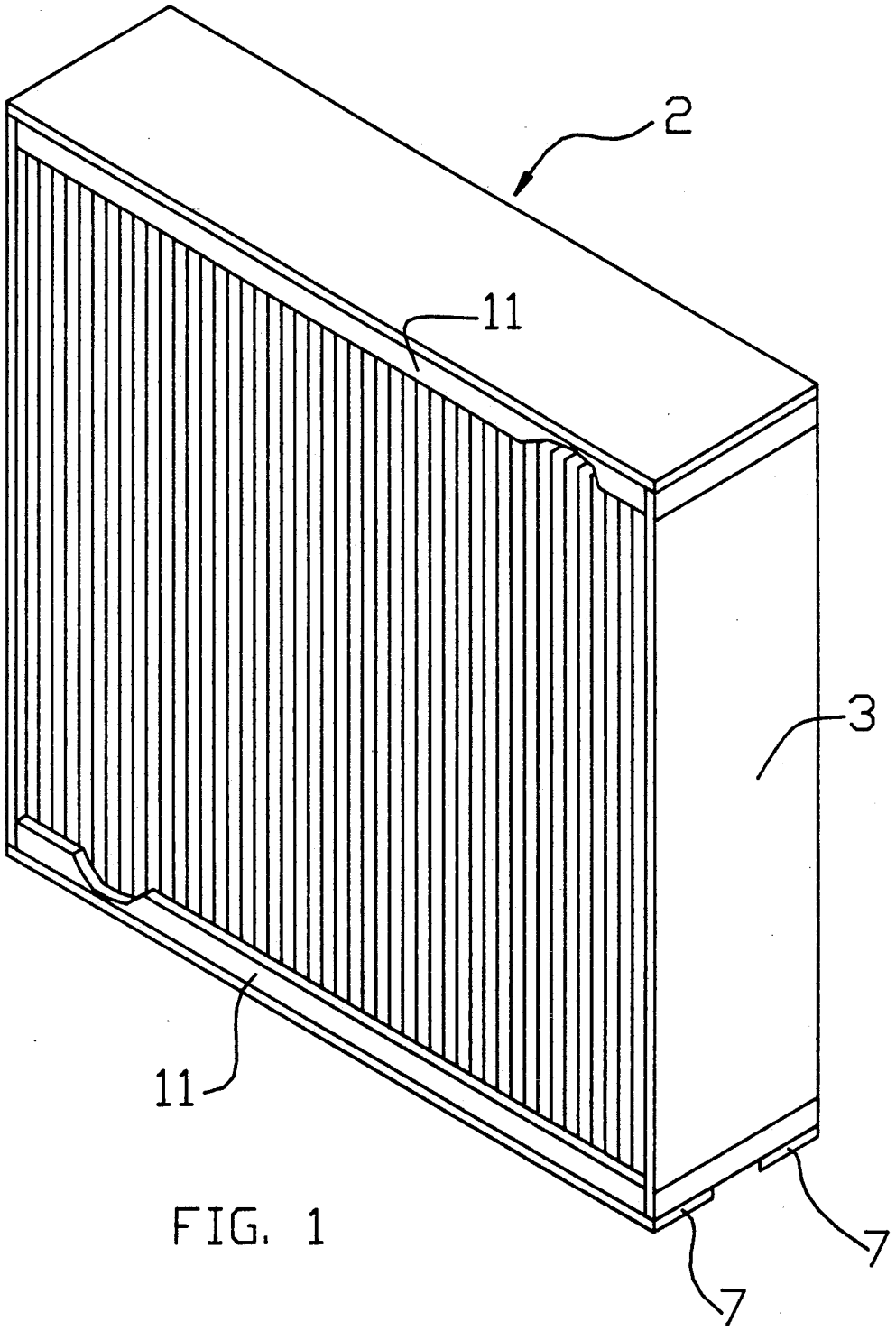
FIG. 1 is an overall perspective, partially broken away view of a novel ventilating and light restricting housing incorporating the several features of the present invention.
Figure 2:
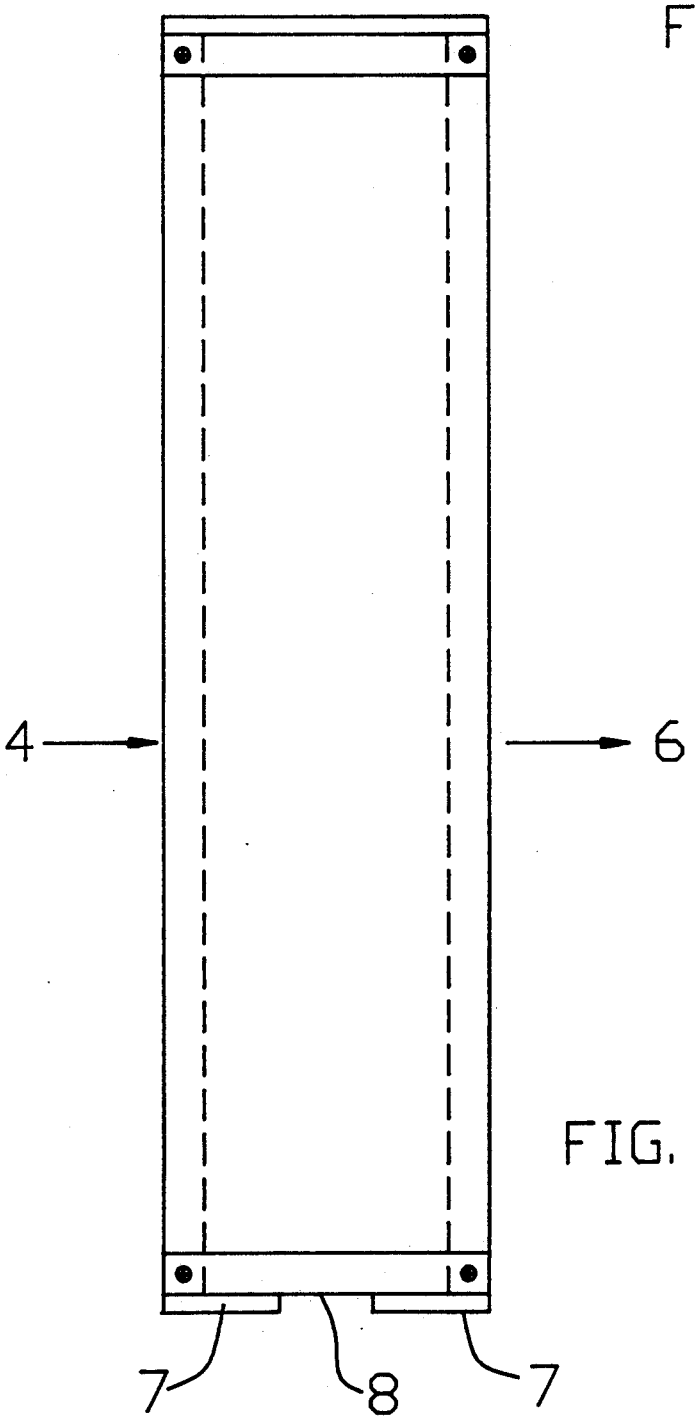
FIG. 2 is a side view of the housing of FIG. 1.

Referring to FIGS. 1-3 of the drawings and particularly to the perspective view of FIG. 1, a novel light restricting housing for a ventilating air system 2 can be seen. Housing 2, which can be formed from any one of a number of suitable materials, such as wood, metal or plastic, includes a flow-through vertically extending frame member 3 which, in the embodiment shown can be of rectangular shape formed from four side panel members joined at the right angle corners by suitable right angle braces to define an upstream ventilating air inlet 4 and a downstream ventilating air outlet 6. Advantageously, in a typical poultry housing, the sides and top panel can be formed from ⅜ inch thick wood strips of a suitable length and a breadth of approximately 13 to 14 inches from ventilating air inlet 4 to ventilating air outlet 6. Suitable metallic right angle braces and wood screws of any one of a number of known hardware types can be employed to join the corners (not shown) or the corners also can be formed by mitering or dovetailing and gluing.

In accordance with one feature of the present invention and as can be seen in FIG. 3, the bottom panel which can be of an appropriately matching length and thickness as the top panel spaced longitudinally extending strips 7 which can be formed from a similar wood material of similar thickness. The strips 7 are spaced from each other to be coextensively parallel providing a gap opening 8 therebetween. This opening 8 in the bottom of housing 2 serves as a ready gravity drainage opening for contaminant flows. In the typical poultry housing aforedescribed, each strip can be approximately 5 inches in breadth to leave a drainage gap of approximately 3 to 4 inches therebetween when joined to the side panels in a similar fashion, such as, by right angle metallic braces and wood screws.

In order to retain the opposed ends of novel blade members, as, hereinafter described, within housing 2, two spaced pairs of spaced parallel and horizontally extending upstream and downstream rail members 11 are provided. These blade members can be of wood and, in the typical poultry housing aforedescribed, are of approximately 1½ inches by ½ inches square cross-section and sized to extend the length of the top and bottom panels between the side panels of housing 2. These spaced rail pairs 11 serve to loosely receive and restrain the opposed longitudinal extremities or ends of the vertically extending, spaced parallel blade members, allowing sufficient tolerance for blade expansion caused by temperature variations and allowing for blade movement during blade cleaning operations.

Figure 5:
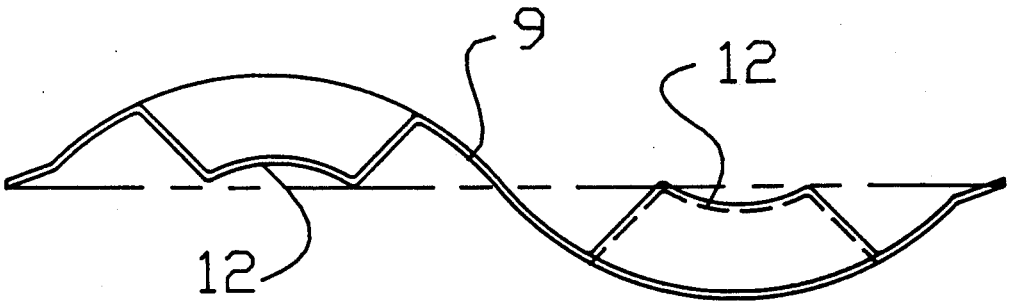
FIG. 5 is a cross-sectional view of one of the blade members of FIG. 4 taken in a plane through line 5—5 of FIG. 4; and, FIG. 6 is a cross-sectional view of one of the blade members similar to the view of FIG. 5, illustrating another possible spacer arrangement.
Figure 4:
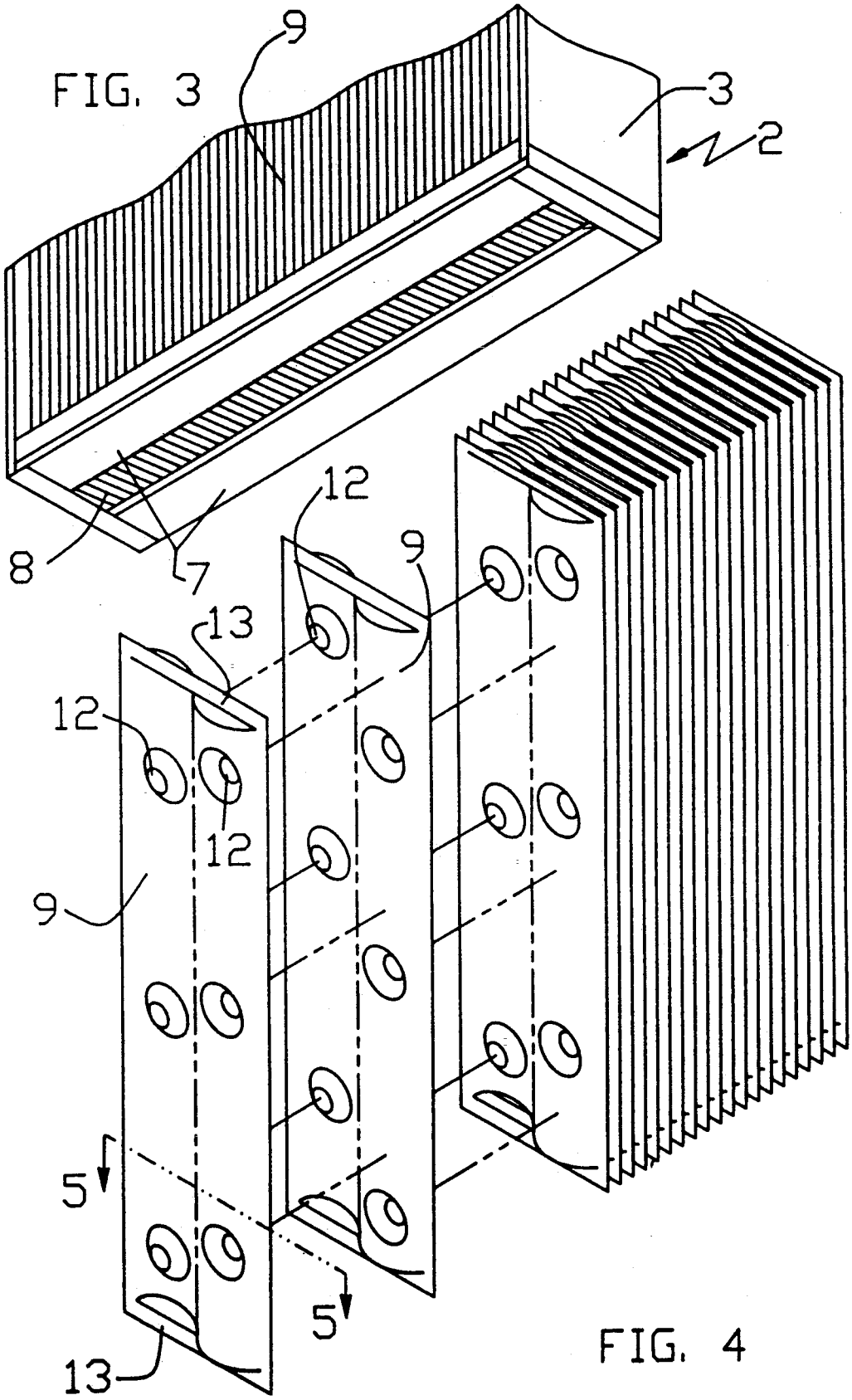
FIG. 4 is a partially exploded vertical view of a portion of the novel blade members which are utilized as part of the assembly of FIGS. 1-3.

Referring to FIGS. 4 and 5 of the drawings, a plurality of the novel blade members 9 can be seen in longitudinally extending, parallel relation for vertical disposition in flow-through housing 2 with their opposed longitudinal extremities loosely disposed for expansion and cleaning purposes between the pairs of horizontally extending upstream and downstream rail members 11 fastened to extend along the opposed upstream and downstream edges of the top and bottom panels of frame 3. The blade members 9 can be formed from any one of several materials and advantageously are formed from an ABS plastic having a "hair cell" texture on both sides and a preformed material thickness of 0.045 for poultry house use, providing sufficient thickness to permit self support and to allow for minor spreading for cleaning purposes. Forming can be accomplished by several methods and it has been found desirable to utilize a vacuum thermoforming method. Although it is possible to dispose the blades in any one of a number of positions, as it can be seen in FIG. 4 of the drawings, for poultry house usage it has been found desirable to dispose the blade members 9 in a vertically extending parallel position within frame 3 with the opposed ends thereof restrained by the pairs of upper and lower panel rail members 11. As can be seen in FIG. 4 of the drawings and as will be described more fully hereinafter, the blade members 9 can be held at a spacing of approximately one inch by a series of formed spacers or dimples 12. It is to be noted, that, with this novel arrangement, no additional hardware is required to be used to accomplish the blade member spacing.

Figure 6:
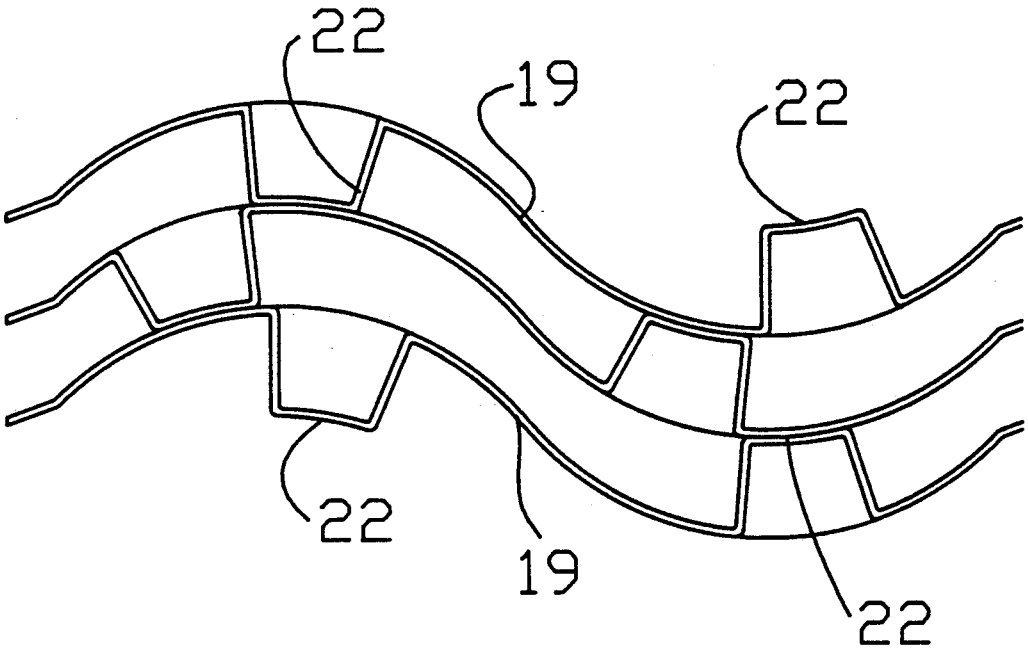

As can be seen in FIG. 5 of the drawings, each blade member 9 advantageously can be formed to have an S-shaped, sinusoidal-like, curved cross-section substantially throughout to allow stream-line flow of ventilating air and to obscure direct passage of light therethrough between the upstream ventilating air inlet 4 and the downstream ventilating air outlet 6. Advantageously, each blade member 9 can be formed to include integrally on the planar faces therewith a plurality of spaced pairs of staggered longitudinally offset integrally formed spacers or dimples 12 which pairs are arranged to extend from the opposite planar surfaces thereof a distance of approximately one inch. Advantageously, three pairs of such dimples or spacers can be provided for each blade member with the pairs positioned near opposite extremities and centrally of the blade members. The offset spacing of each of the pairs of dimples 12 on opposite surfaces of blade members 11 and the sinusoidal or S-shaped cross-section allows successively adjacent blade members 9 to be positioned in relatively inverted, parallel, longitudinally extending relation to each other with the dimples 12 of one blade member 9, being offset from the dimples 12 of an adjacent blade member 9, so as to enhance manufacture and assembly of the light restricting housing 2 without requiring any time-consuming fixturing of the blade assembly. Although the blades shown include longitudinally offset spacers, it is to be understood that other spacer arrangements could be used including spacers which are laterally offset as shown in FIG. 6 of the drawings where spacers 22 on blade members 19 are so shown. Again referring to FIG. 4 of the drawings, it is to be noted that, in accordance with another feature of the present invention, each blade member 9 is configured in formation so as to include a continuous peripheral surrounding edge 13 determined by a common plane with the edge 13 at opposite blade extremities not only enhancing blade stability and stiffness along with dimples or spacers 12 but also improving blade drainage at the lower portion thereof through bottom gap 8 of frame 3.

Finally, it is to be understood that the present invention is not be considered as limited to the particular blade cross-sectional and spacer or dimple or raised surface pattern disclosed, but that other blade cross-sectional contours and other raised surface patterns and means to affix the spacers to planar blade surfaces to be a part thereof can be employed.

The invention claimed is:

1. A light restricting housing for a ventilating air system comprising:

a flow-through frame member including an upstream ventilating air inlet and a downstream ventilating air outlet;

a plurality of longitudinally extending blade members disposed in said flow-through frame member to extend thereacross in spaced parallel relation between said upstream ventilating air inlet and said downstream ventilating air outlet, said blade members each having a cross-section contoured to obscure direct passage of light therethrough between said upstream ventilating air inlet and said downstream ventilating air outlet; means to retain said blade members in disposed position within said flow-through frame member; and, displacement means integral with the planar faces of said blade members to freely abut against planar faces of adjacent blade members to hold said blade members in spaced relation to each other.

2. The light restricting housing for a ventilating air stream of claim 1, said blade members having an S-shaped sinusoidal like curved cross-section.

3. The light restricting housing for a ventilating air stream of claim 1, said blade members being vertically disposed in said flow-through frame member.

4. The light restricting housing for a ventilating air stream of claim 1, said flow-through frame member including an opening extending intermediate said upstream air inlet and said downstream air outlet in the lower portion thereof for drainage of contaminant flows.

5. The light restricting housing for a ventilating air stream of claim 1, said retaining means for said blade members comprising spaced pairs of upstream and downstream rail members fastened to extend along opposed sides of said frame member to restrain movement of opposed longitudinal extremities of said blade members.

6. The light restricting housing for a ventilating airstream of claim 1, said flow-through frame member being of rectangular shape to include four wooden panel side members, the lower panel being comprised of two spaced longitudinally extending strips to provide a gap opening therebetween for drainage of contaminant flows.

7. The light restricting housing for a ventilating air stream of claim 1, said blade members being of plastic material of preselected thickness to provide self-supporting stiffness with sufficient flexibility to allow spreading for cleaning purposes.

8. The light restricting housing for a ventilating air stream of claim 1, said displacement means integral with said blade members including a plurality of selectively spaced relatively staggered dimples on the planar surfaces of each blade member so spaced that immediately adjacent longitudinally extending parallel blade members can be positioned in relatively inverted parallel relation to each other with the dimples of one blade member being offset from the dimples of an adjacent blade member.

9. The light restricting housing for a ventilating air stream of claim 1, said contoured blade members each having a peripheral surrounding edge determined by a common plane to enhance the structural stability and stiffness thereof.

10. The light restricting housing for a ventilating air stream of claim 1, said displacement means being integrally formed portions on said blade members.

11. A light restricting housing for a ventilating air system comprising:

a flow-through vertically extending frame member of rectangular shape formed from four wooden side panel members joined at the corners by right angle braces to define an upstream ventilating air inlet and a downstream ventilating air outlet with the lower panel member including two spaced longitudinally extending strips to provide a gap opening therebetween for drainage of contaminant flows therethrough and with the upper and lower panels having spaced pairs of horizontally extending upstream and downstream rail members fastened thereto to loosely receive and restrain opposed longitudinal extremities of vertically extending spaced parallel blade members therein;

a plurality of longitudinally extending, parallel blade members vertically disposed in said flow-through frame member with their longitudinal extremities loosely disposed for expansion purposes between said pairs of horizontally extending upstream and downstream rail members of said rectangular frame, said blade members having an S-shaped sinusoidal-like curved cross-section substantially throughout to allow stream-line flow and to obscure direct passage of light therethrough between said upstream ventilating air inlet and said downstream ventilating air outlet, said blade members being of preselected thickness to provide self supporting stiffness with sufficient flexibility to allow spreading for cleaning purposes each blade including a plurality of spaced pairs of staggered integrally formed dimples extending from the surface thereof with the dimples so spaced that immediately adjacent blade members can be positioned in relatively inverted parallel longitudinally extending relation to each other with the dimples of one blade member being offset from the dimples of an adjacent blade member, each blade member further having a continuous peripheral surrounding edge determined by a common plane to enhance the structural stability and stiffness thereof.

* * * * *